US011183164B2

(12) United States Patent
Yokoyama et al.

(10) Patent No.: US 11,183,164 B2
(45) Date of Patent: Nov. 23, 2021

(54) HORN DEVICE FOR RAILCAR

(71) Applicant: KAWASAKI JUKOGYO KABUSHIKI KAISHA, Kobe (JP)

(72) Inventors: Mitsuru Yokoyama, Kobe (JP); Kazuya Tanigawa, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 499 days.

(21) Appl. No.: 16/173,888

(22) Filed: Oct. 29, 2018

(65) Prior Publication Data

US 2019/0130884 A1 May 2, 2019

(30) Foreign Application Priority Data

Oct. 31, 2017 (JP) ..... JP2017-211057

(51) Int. Cl.

| | |
|---|---|
| ***G10K 11/02*** | (2006.01) |
| ***G10K 5/00*** | (2006.01) |
| ***G10K 11/26*** | (2006.01) |
| ***G10K 11/36*** | (2006.01) |

(52) U.S. Cl.

CPC ..... *G10K 11/025* (2013.01); *G10K 5/00* (2013.01); *G10K 11/26* (2013.01); *G10K 11/36* (2013.01)

(58) Field of Classification Search

CPC ..... B60Q 5/00; B60K 11/04; B61D 27/00; B61D 27/009; B61D 27/0018; B60H 1/26; Y02T 30/00; B62J 3/00; G10K 11/025; G10K 11/26; G10K 11/28; G10K 11/36; G10K 5/00; G10K 9/10

USPC ..... 181/144, 180, 185, 186, 187, 188, 192, 181/177, 159, 132, 175, 179, 193, 194, 181/195, 198, 199; 381/340, 341, 342, 381/182, 150, 337, 386; 116/137 R, 140, 116/141, 142 R, 142 FP

See application file for complete search history.

(56) References Cited

U.S. PATENT DOCUMENTS

| | | | | |
|---|---|---|---|---|
| 1,786,122 | A * | 12/1930 | McElvaney, Jr. | G10K 5/00 116/137 R |
| 5,329,872 | A * | 7/1994 | Wright | G10K 5/00 116/137 R |
| 5,546,887 | A * | 8/1996 | Cameron | G10K 5/00 116/137 R |
| 2003/0182937 | A1* | 10/2003 | Fukumoto | F01N 13/08 60/323 |
| 2010/0261403 | A1* | 10/2010 | Shishido | G10K 5/00 446/204 |

FOREIGN PATENT DOCUMENTS

| | | |
|---|---|---|
| JP | S59-020299 U | 2/1984 |

* cited by examiner

*Primary Examiner* — Leshui Zhang
(74) *Attorney, Agent, or Firm* — Oliff PLC

(57) ABSTRACT

There is provided a horn device for a railcar capable of delivering horn sound to a long distance in a traveling direction and being less likely to spread sound in a car width direction. A horn device for a railcar according to one aspect of the present invention includes: a whistle portion that is supplied with compressed air to make horn sound in a traveling direction; a duct located in the traveling direction of the whistle portion and having an opening portion at an end portion in the traveling direction; and at least one partition plate that is disposed perpendicularly to a car width direction, extends in a car longitudinal direction, and divides the interior of the duct.

5 Claims, 4 Drawing Sheets

HORN DEVICE FOR RAILCAR

BACKGROUND OF THE INVENTION

(1) Field of the Invention

The present invention relates to a horn device for a railcar.

(2) Description of Related Art

As a horn device for a railcar, there are one equipped with an electric whistle that amplifies sound emitted from a speaker to emit the sound, and one equipped with an air whistle that is supplied with compressed air to make horn sound (see JP S59-20299 Y). Since the air whistle can increase an output as compared with the electric whistle, adopting the air whistle is desirable to deliver horn sound to a long distance.

SUMMARY OF THE INVENTION

Meanwhile, in recent years, there has been a request to increase directivity of horn sound emitted from a horn device, to suppress spreading of the sound in a car width direction in consideration of neighbors of a route. As a method of improving the directivity, it is conceivable to cover an electric whistle or an air whistle with a duct having an opening portion at an end portion in a traveling direction. Then, theoretically, the directivity is considered to be further improved by subdividing an interior of the duct as possible in a vertical direction and a horizontal direction.

However, subdividing the interior of the duct causes a peculiar problem in the air whistle. In other words, it is noise due to resonance of a member partitioning the interior of the duct. Since the sound emitted from the air whistle contains sounds of various frequencies, unlike the electric whistle, it is not possible to control the frequency so as to avoid resonance with the member partitioning the interior of the duct. Therefore, in the horn device having the air whistle, as the interior of the duct is subdivided, noise becomes more easily generated due to the resonance of the partitioning member with the sound of any frequency, which may cause the sound to spread in the car width direction instead.

The present invention has been made in view of the above circumstances, and it is an object of the present invention to provide a horn device for a railcar capable of delivering horn sound to a long distance in a traveling direction and being less likely to spread sound in a car width direction.

A horn device for a railcar according to one aspect of the present invention includes: a whistle portion that is supplied with compressed air to make horn sound in a traveling direction; a duct located on the traveling direction side of the whistle portion and having an opening portion at an end portion in the traveling direction; and at least one partition plate that is disposed perpendicularly to a car width direction, extends in a car longitudinal direction, and divides the interior of the duct.

By including the whistle portion that is supplied with compressed air to make horn sound in the traveling direction, this horn device can deliver the horn sound to a long distance in the traveling direction. In addition, the horn device includes the partition plate that is disposed perpendicularly to the car width direction, extends in the car longitudinal direction, and divides the interior of the duct. This can suppress spreading of the horn sound in the car width direction, and enhance the directivity of the horn sound. Further, the horn device does not have a partition plate perpendicular to the vertical direction (that is, horizontal). Therefore, although the horn sound may spread in the vertical direction, the partition plate does not resonate to generate noise, and the noise does not spread in the car width direction.

Therefore, according to the above configuration, it is possible to provide a horn device for a railcar capable of delivering horn sound to a long distance in a traveling direction and being less likely to spread sound in a car width direction.

DETAILED DESCRIPTION OF PREFERRED EMBODIMENTS

Figure 1:
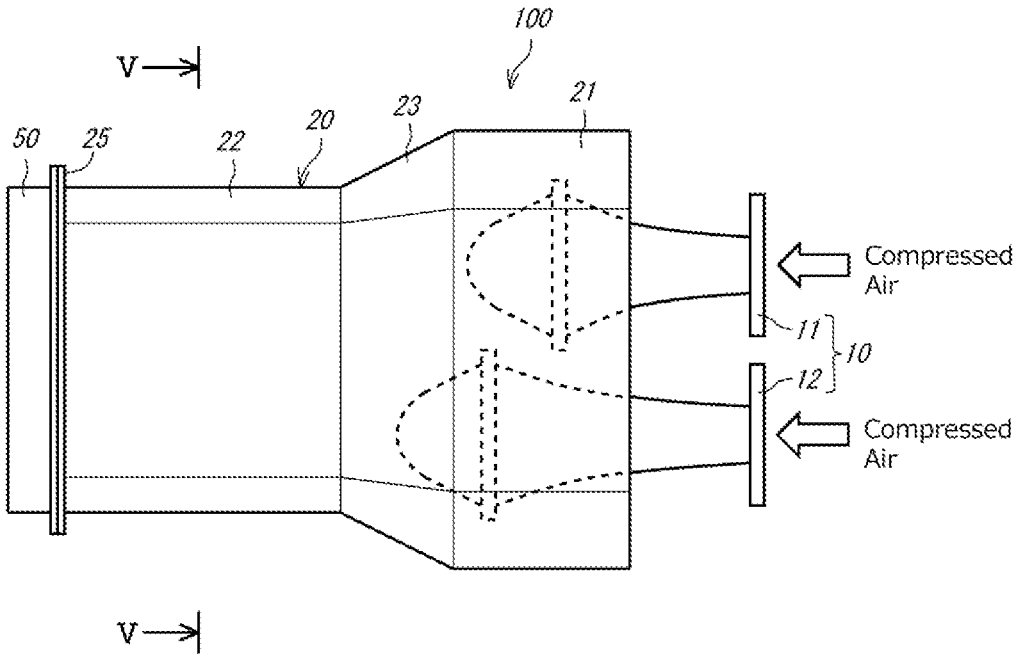
FIG. 1 is a plan view of a horn device.

Hereinafter, an embodiment of the present invention will be described with reference to the drawings. In the following description, the same reference numerals are given to the same or equivalent elements throughout all the drawings, and redundant explanation will be omitted.

<Structure of Horn Device>

Figure 2:
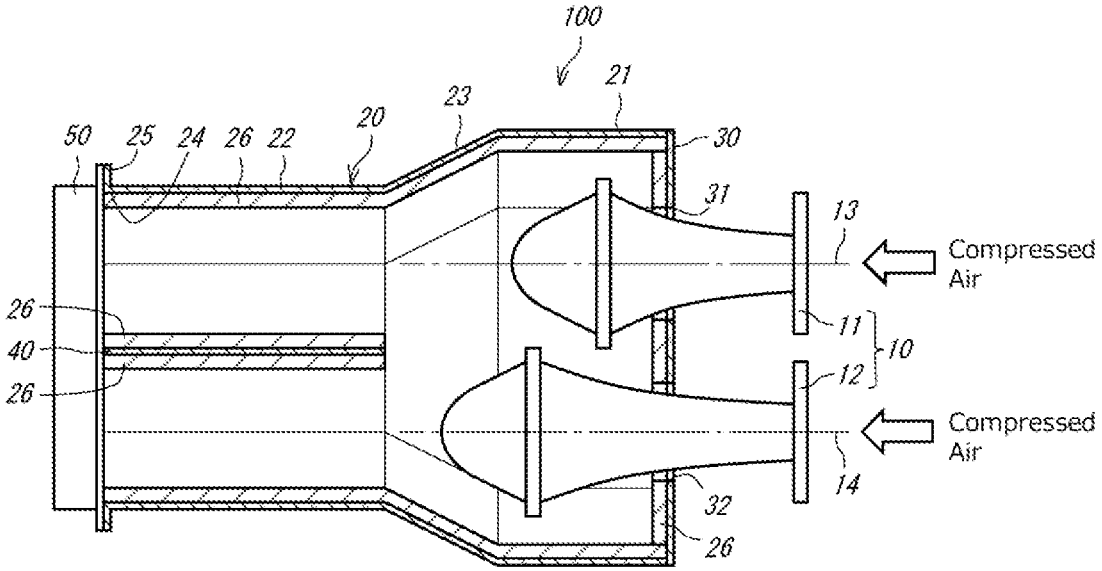
FIG. 2 is a plan view of the horn device with an upper portion of a duct removed.
Figure 3:
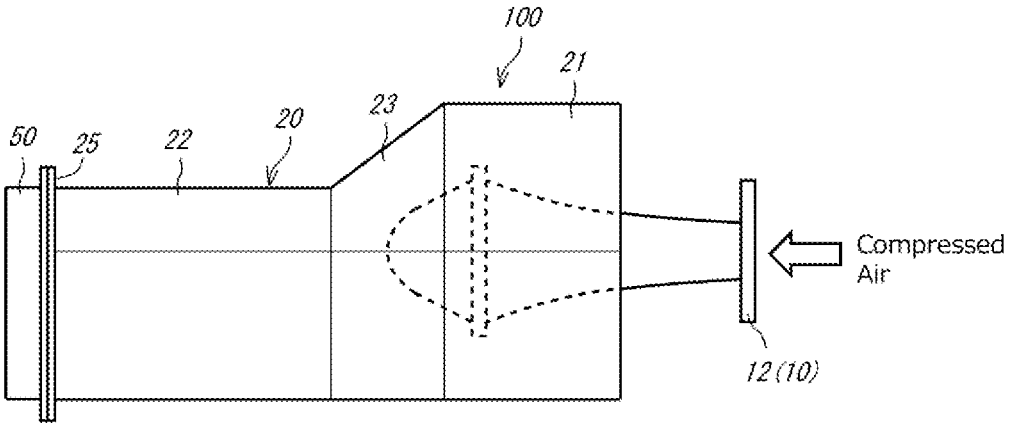
FIG. 3 is a side view of the horn device.
Figure 4:
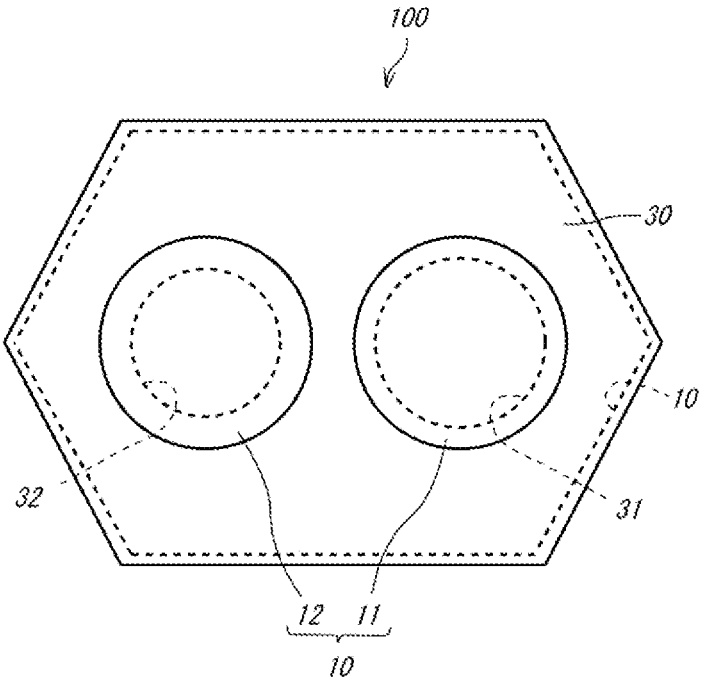
FIG. 4 is a rear view of the horn device.
Figure 5:
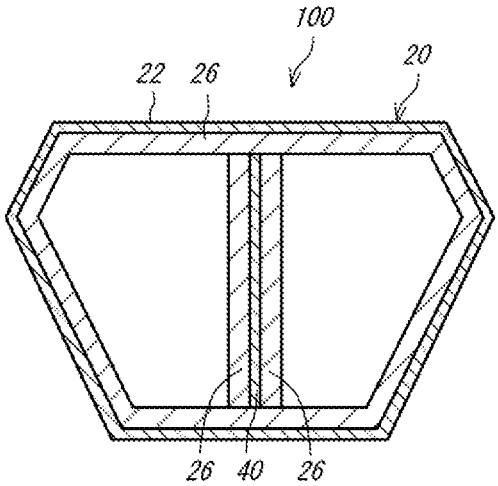
FIG. 5 is a cross-sectional view taken along arrow V-V in FIG. 1.

First, an overall configuration of a horn device 100 will be described. FIG. 1 is a plan view of the horn device 100, and FIG. 2 is also a plan view of the horn device 100 with an upper portion of a duct 20 removed. FIG. 3 is a side view of the horn device 100, and FIG. 4 is a rear view of the horn device. FIG. 5 is a cross-sectional view taken along arrow V-V in FIG. 1.

The horn device 100 according to the present embodiment is a horn device for a railcar, which is mounted on a railcar. A horizontal direction of the page of FIG. 1 is a car longitudinal direction, and a vertical direction of the page is a car width direction. Further, the left side of the page of FIG. 1 is a traveling direction, and the right side of the page is a reverse traveling direction. As shown in FIG. 2, the horn device 100 according to the present embodiment includes a whistle portion 10, the duct 20, a back plate 30, a partition plate 40, and a louver 50. These constituent elements will be sequentially described below.

The whistle portion 10 is a part to make horn sound, and has two air whistles. Specifically, the whistle portion 10 has a first air whistle 11 and a second air whistle 12 arranged side by side in the car width direction. Both the first air whistle 11 and the second air whistle 12 extend in the car longitudinal direction, and make horn sound in the traveling direction when compressed air is supplied. The air whistle is divided into a substantially disc-shaped vibration portion into which compressed air is supplied, and a bell portion to magnify vibration of the vibration portion. The horn sounds respectively made by the first air whistle 11 and the second air whistle 12 have different pitches, and lengths and shapes of the bell portions are different in conformity with the pitches. The first air whistle 11 and the second air whistle 12 are sounded simultaneously, but each air whistle may be sounded individually. Here, in order to ensure magnitude of the sound required for the entire whistle portion 10, the bell portions of the first air whistle 11 and the second air whistle 12 are arranged such that shapes and positions in the car longitudinal direction are different from each other. Although the whistle portion 10 of the present embodiment has two air whistles, one air whistle alone or three or more air whistles may be provided. Moreover, the bell portion of the present embodiment is provided with a substantially semi-spherical wire mesh on the traveling direction side (distal end portion) in order to suppress entering of dust or the like, but the wire mesh may be omitted.

The duct 20 is located closer to the traveling direction than the whistle portion 10, and covers the traveling direction side (distal end portion) of the whistle portion 10. That is, the duct 20 is located on the traveling direction side of the whistle portion 10. The duct 20 is formed in a tubular shape as a whole, and has a base end portion 21 located on the reverse traveling direction side, a distal end portion 22 located on the traveling direction side, and an intermediate portion 23 located between the base end portion 21 and the distal end portion 22. Both the base end portion 21 and the distal end portion 22 have a hexagonal shape in a cross section (see FIGS. 4 and 5). It is sufficient that the duct 20 is formed in a tubular shape as a whole, and a cylindrical shape or a square tubular shape may also be adopted, for example.

However, as shown in FIG. 3, height positions of lower faces of the base end portion 21 and the distal end portion 22 are the same, whereas a height position of an upper face of the distal end portion 22 is lower than that of the base end portion 21. Further, as shown in FIG. 1, a dimension of the distal end portion 22 in the car width direction is smaller than that of the base end portion 21. Therefore, in the duct 20, a vertical cross-sectional area at an end portion in the traveling direction is smaller than a vertical cross-sectional area at an end portion in the reverse traveling direction. Therefore, a passage cross-sectional area at the end portion in the traveling direction is smaller than a passage cross-sectional area at the end portion in the reverse traveling direction.

Further, the duct 20 (the distal end portion 22) has an opening portion 24 at the end portion in the traveling direction. Then, so as to surround the opening portion 24, a flange 25 perpendicular to the car longitudinal direction is annularly formed. The flange 25 is a part to fix the louver 50, which is described later. Further, as shown in FIGS. 2 and 5, an inner peripheral surface of the duct 20 is provided with a sound absorbing material 26 for absorption of sound.

The back plate 30 is a plate-shaped member, and is provided at the end portion in the reverse traveling direction in the duct 20. As shown in FIG. 4, the back plate 30 has a hexagonal shape in rear view, corresponding to the shape of the base end portion 21 of the duct 20. In addition, in the back plate 30, there are formed a first through hole 31 and a second through hole 32 through which the first air whistle 11 and the second air whistle 12 respectively pass. Meanwhile, a sound absorbing material or the like may be filled in the first through hole 31 and the second through hole 32, to fill gaps between the air whistles 11 and 12 and the back plate 30. Further, as shown in FIG. 2, the sound absorbing material 26 is provided on an inner surface of the back plate 30.

The partition plate 40 is a member to divide an interior of the duct 20. As shown in FIG. 5, the partition plate 40 is disposed perpendicularly to the car width direction (horizontal direction of the page). Further, as shown in FIG. 2, the partition plate 40 is provided in a range corresponding to the distal end portion 22 of the duct 20, and extends in the car longitudinal direction. However, the partition plate 40 may extend beyond the range corresponding to the distal end portion 22. Note that the horn device 100 according to the present embodiment does not have a partition plate perpendicular to the vertical direction (that is, horizontal). Therefore, a space located on both sides in the car width direction of the partition plate 40 continuously extends from an upper portion to a lower portion of the duct 20. In addition, the horn device 100 may also include a plurality of partition plates 40 perpendicular to the car width direction.

Further, the partition plate 40 is located, in the car width direction, between a center axis 13 of the first air whistle 11 extending in the car longitudinal direction through a central portion of the first air whistle 11, and a center axis 14 of the second air whistle 12 extending in the car longitudinal direction through a central portion of the second air whistle 12. Then, the partition plate 40 divides the interior of the duct 20 in the car width direction into the same number as the air whistles 11 and 12 (that is, two). Further, both sides of the partition plate 40 in the car width direction are provided with the sound absorbing material 26.

Figure 6:
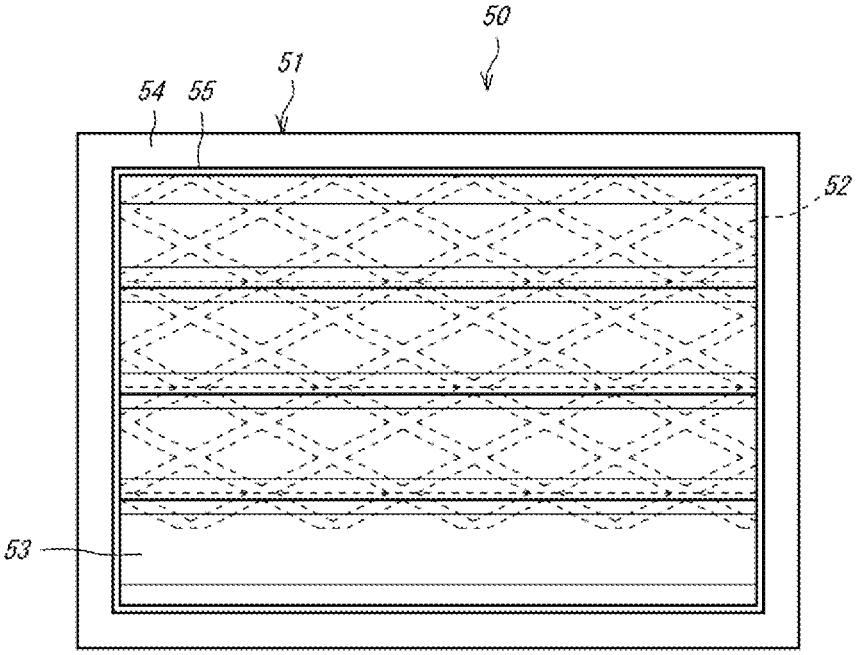
FIG. 6 is a front view of a louver.
Figure 7:
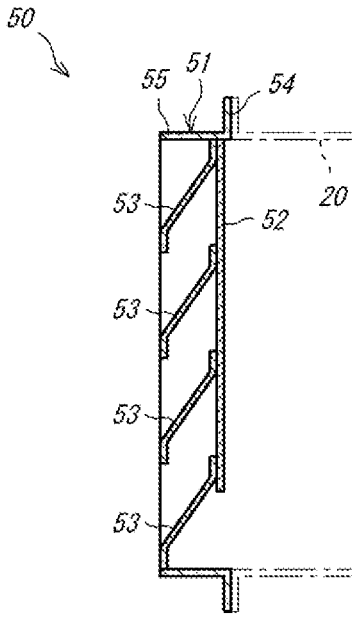
FIG. 7 is a longitudinal cross-sectional view of the louver.

The louver 50 is a device to suppress entering of foreign matter into the duct 20 when the railcar travels. As shown in FIG. 2, the louver 50 is fixed to the flange 25 of the duct 20, and is provided to the opening portion 24 of the duct 20. Here, FIG. 6 is a front view of the louver 50, and FIG. 7 is a longitudinal cross-sectional view of the louver 50. The left side of the page of FIG. 7 is the traveling direction of the railcar. As shown in FIGS. 6 and 7, the louver 50 has a frame body 51, a mesh plate 52, and a plurality (four in the present embodiment) of blade plates 53.

The frame body 51 has a rectangular shape. The frame body 51 has an outer frame portion 54 fixed to the flange 25 of the duct 20, and an annular wall portion 55 extending from the outer frame portion 54 toward the traveling direction. The mesh plate 52 is formed in a mesh shape, and a plurality of streak portions extending in a streak shape cross each other. As shown in FIG. 6, the blade plates 53 each extend in the car width direction, and are arranged such that vertically adjacent blade plates 53 in a front view are partially overlapped with each other.

Further, as shown in FIG. 7, the blade plate 53 is fixed to the mesh plate 52 by a fixing tool (not shown). In a side view, the blade plate 53 is inclined so as to be located downward as advancing in the traveling direction. Therefore, a passage formed between vertically adjacent blade plates 53 extends forward and downward from the opening portion 24 of the duct 20. As a result, air emitted from the whistle portion 10 is directed downward by passing between the blade plates 53. Meanwhile, each of the blade plates 53 may be configured to direct the air emitted from the whistle portion 10 upward.

<Effect and Others>

Next, effects and the like of the horn device 100 according to the present embodiment will be described. As described above, the horn device 100 for a railcar according to the present embodiment is provided with: the whistle portion 10 that is supplied with compressed air to make horn sound in the traveling direction; the duct 20 located in the traveling direction of the whistle portion 10 and having the opening portion 24 at the end portion in the traveling direction; and at least one partition plate 40 that is disposed perpendicularly to the car width direction, extends in the car longitudinal direction, and divides the interior of the duct 20.

In this way, by including the whistle portion 10 that is supplied with compressed air to make horn sound in the traveling direction, the horn device 100 can deliver the horn sound to a long distance in the traveling direction. In addition, the horn device 100 includes the partition plate 40 that is disposed perpendicularly to the car width direction, extends in the car longitudinal direction, and divides the interior of the duct. This can suppress spreading of the horn sound in the car width direction, and enhance the directivity of the horn sound. Further, in the horn device 100, there is provided no partition plate 40 that is perpendicular to the vertical direction (that is, horizontal) and does not contribute to the reduction of spreading of the horn sound in the car width direction. This can reduce the risk of noise caused by resonance of the partition plate itself due to addition of unnecessary partition plates. Therefore, the horn device 100 according to the present embodiment can deliver the horn sound to a long distance in the traveling direction, and is less likely to spread the sound in the car width direction.

Further, the horn device 100 according to the present embodiment further includes the louver 50 disposed to the opening portion 24 and having a plurality of blade plates 53 to direct air emitted from the whistle portion 10 upward or downward.

Therefore, even when a foreign matter comes flying from the traveling direction side while the railcar is traveling, the foreign matter collides with the louver 50, which can suppress entering of the foreign matter into the duct 20 of the horn device 100. In addition, the louver 50 according to the present embodiment directs the air emitted from the whistle portion 10 upward or downward instead of in the car width direction. This can suppress spreading of the sound emitted from the whistle portion 10 in the car width direction. Particularly, in a case where the plurality of blade plates 53 direct the air emitted from the whistle portion 10 downward, since water droplets and dust hitting on the plurality of blade plates 53 are discharged downward, water droplets and dust are less likely to enter the duct 20.

In addition, the horn device 100 according to the present embodiment is provided with the sound absorbing material 26 on the inner peripheral surface of the duct 20.

When sound emitted from the whistle portion 10 is reflected on the inner peripheral surface of the duct 20, the sound spreads in various directions and also spreads in the car width direction. On the other hand, providing the sound absorbing material 26 on the inner peripheral surface of the duct 20 as described above enables suppression of the reflection of the sound emitted from the whistle portion 10, on the inner peripheral surface of the duct 20. This can further suppress spreading of the sound emitted from the horn device 100 in the car width direction.

Further, in the duct 20 in the horn device 100 according to the present embodiment, the vertical cross-sectional area at the end portion in the traveling direction is smaller than the vertical cross-sectional area at the end portion in the reverse traveling direction.

Therefore, the sound emitted from the whistle portion 10 is directed in the traveling direction, and the directivity of the horn sound advancing in the traveling direction can be improved. This can further suppress spreading of the sound emitted from the whistle portion 10 in the car width direction.

Further, in the horn device 100 according to the present embodiment, the whistle portion 10 has the plurality of air whistles 11 and 12 arranged side by side in the car width direction, and the partition plate 40 is located between the center axes 13 and 14 of adjacent air whistles 11 and 12 in the car width direction among the plurality of air whistles 11 and 12, and divides the interior of the duct 20 into the same number as the air whistles 11 and 12.

Here, the following Table 1 shows an example of an experimental result of measuring magnitude of sound in each direction, in a case (Case 1) where one partition plate 40 is disposed between the center axis 13 of the first air whistle 11 and the center axis 14 of the second air whistle 12 in the car width direction as in the present embodiment, and in a case (Case 2) where two partition plates 40 are respectively disposed near the center axis 13 of the first air whistle 11 and near the center axis 14 of the second air whistle 12 in the car width direction.

TABLE 1

| | Distance from sound source | Front | Right 45 degrees | Right 90 degrees | Right 135 degrees | Left 135 degrees | Left 90 degrees | Left 45 degrees |
|---|---|---|---|---|---|---|---|---|
| Case 1 | 3.0 m | 98.6 | 93.2 | 89.4 | 87.3 | 85.7 | 86.4 | 90.7 |
| | 4.5 m | 98.4 | 93.5 | 88.9 | 87.3 | 87.1 | 87.2 | 91.0 |
| Case 2 | 3.0 m | 98.7 | 93.1 | 90.0 | 87.7 | 86.1 | 87.0 | 90.7 |
| | 4.5 m | 98.7 | 93.2 | 89.5 | 87.5 | 86.5 | 87.5 | 91.3 |

In the experiment, with the distal end of the horn device 100 as a reference point, a microphone was set at positions of 3.0 m and 4.5 m from the reference point, and magnitude of sound was measured at each of angular positions of the front, the front 45 degrees, the right 45 degrees, the right 90 degrees, the right 135 degrees, the left 135 degrees, the left 90 degrees, and the left 45 degrees. Numerical values in the table indicate magnitude (decibel) of the sound calculated from the measured sound magnitude, at a point 100 ft (about 30 m) away from the reference point. That is, in Table 1, it can be said that spreading of sound in the car width direction is suppressed as the numerical values of angles other than the front (in particular, right 90 degrees and left 90 degrees) are smaller.

As shown in Table 1, for angular positions of at least the right 90 degrees and the left 90 degrees, the numerical values of Case 1 are smaller than those of Case 2. That is, as compared with Case 2, Case 1 can suppress spreading of the sound in the car width direction. Therefore, as in the present embodiment, when the horn device 100 includes the plurality of air whistles 11 and 12, spreading of sound in the car width direction can be further suppressed by locating the partition plate 40 between the center axes 13 and 14 of the air whistles 11 and 12 and dividing the interior of the duct 20 into the same number as the air whistles 11 and 12.

What is claimed is:

1. A horn device for a railcar, the horn device comprising:

a whistle portion that is supplied with compressed air to make horn sound in a direction that the railcar travels;

a duct located in front of the whistle portion with respect to the direction that the railcar travels, the duct having an opening portion at a front end portion with respect to the direction that the railcar travels; and at least one partition plate that is perpendicular to a car width direction, extends in a car longitudinal direction, and divides an interior of the duct.

2. The horn device for a railcar according to claim 1, further comprising a louver at the opening portion, the louver having a plurality of blade plates adapted to direct air emitted from the whistle portion upward or downward.

3. The horn device for a railcar according to claim 1, further comprising a sound absorbing material on an inner peripheral surface of the duct.

4. The horn device for a railcar according to claim 1, wherein, in the duct, a vertical cross-sectional area at the front end portion is smaller than a vertical cross-sectional area at a rear end portion.

5. The horn device for a railcar according to claim 1, wherein the whistle portion has a plurality of air whistles arranged side by side in the car width direction; and the partition plate is located between center axes of adjacent air whistles among the plurality of air whistles in the car width direction, and divides an interior of the duct into a same number as a number of the air whistles.

* * * * *